US006488095B2

(12) United States Patent
Buytaert

(10) Patent No.: US 6,488,095 B2
(45) Date of Patent: Dec. 3, 2002

(54) METHOD AND APPARATUS FOR ORIENTING A WHIPSTOCK IN AN EARTH BOREHOLE

(75) Inventor: Jean P. Buytaert, Houston, TX (US)

(73) Assignee: Frank's International, Inc., Houston, TX (US)

( * ) Notice: Subject to any disclaimer, the term of this patent is extended or adjusted under 35 U.S.C. 154(b) by 4 days.

(21) Appl. No.: 09/767,550

(22) Filed: Jan. 23, 2001

(65) Prior Publication Data

US 2002/0096326 A1 Jul. 25, 2002

(51) Int. Cl.[7] ..... E21B 47/09
(52) U.S. Cl. ..... 166/382; 166/117.5; 166/117.6
(58) Field of Search ..... 166/50, 117.5, 166/117.6, 207, 382

(56) References Cited

U.S. PATENT DOCUMENTS 4,031,954 A * 6/1977 Herbert et al. ..... 166/117.5
4,066,128 A * 1/1978 Davis et al. ..... 166/117.5
4,742,871 A * 5/1988 Miffre ..... 166/117.5
5,467,819 A * 11/1995 Braddick ..... 166/117.6
5,732,773 A * 3/1998 Parks et al. ..... 166/117.5
5,862,859 A * 1/1999 Speed et al. ..... 166/117.5
2002/0066577 A1 * 6/2002 Dewey et al. ..... 166/382

* cited by examiner

*Primary Examiner*—David Bagnell
*Assistant Examiner*—T Shane Bomar
(74) *Attorney, Agent, or Firm*—The Matthews Firm

(57) ABSTRACT

A reference sleeve is used to orient a whipstock assembly to direct a pipe string into a new borehole section. The whipstock assembly may be removed such that a pipe string may enter the original borehole through the relatively large inner diameter of the expanded reference sleeve. The reference sleeve provides a permanent reference without forming an obstruction in the wellbore. To go back into the new borehole section, the whipstock assembly will be oriented automatically within the reference sleeve such that a pipe string will be reliably directed into the new borehole section, even years later. The reference sleeve is preferably run into the hole in a running position that is radially compressed. After orientation, the reference sleeve is expanded to thereby engage the wellbore and be affixed in position. Orientation surfaces include sloping guide surfaces and a slot that mate to a key on the whipstock assembly. The reference sleeve may be used for any reference purpose in the wellbore, e.g., for providing a wireline logging depth reference.

25 Claims, 5 Drawing Sheets

METHOD AND APPARATUS FOR ORIENTING A WHIPSTOCK IN AN EARTH BOREHOLE

BACKGROUND OF THE INVENTION (1) Field of the Invention

The present invention relates generally to a permanent locating system that may be used to selectively access wellbore sections and/or for other purposes. In a more particular embodiment, the present invention is especially suitable to provide reliable and repeatable downhole whipstock orientation.

(2) Description of the Prior Art

It is often desirable, in both cased and open hole, to branch off one or more times from an existing wellbore or to sidetrack away from an object such as a fish or toward an object such as a revised geological target. A whipstock may be used as a guide for the drill bit or mill in creating the new borehole sections, casing windows, and the like, so that the new borehole section is oriented in the desired direction. The whipstock is anchored in the wellbore at the desired depth at which the new well is to be kicked off. The bit or mill engages the generally metallic whipstock face or surface that is typically angled so as to urge the bit or mill in a desired direction. In this manner, it is well known that the mill or drill bit is thereby directed to mill or drill in the direction intended for the new wellbore section. The whipstock face may be left in the existing wellbore to guide the drill string, production string, and the like into the new borehole section.

However, at some time after the new wellbore branch is drilled, it may be desirable to obtain access to the original borehole such as with a drill string or production string. Moreover after gaining access to the original borehole once again, sometime later it may be desirable to reliably obtain access once again to the new wellbore branch with a drill string and/or production string. Moreover, there may be multiple branches in the wellbore and it may be desirable to be able to reliably and selectively obtain access to any one of them. In the past, bent drill strings and subs have been used for this purpose, but often with little success. Generally, obtaining access to the various sections of the wellbore has been unreliable at best.

Consequently, it would be desirable to provide a system and method that is designed to reliably and consistently control access to any branch or borehole section as desired. Those skilled in the art will appreciate the present invention that addresses the above and other needs and problems.

SUMMARY OF THE INVENTION

Accordingly, it is an object of the present invention to provide an improved location system and method. It is yet another object of the present invention to provide an improved system and method for reliably obtaining access to any wellbore branch or section.

It is yet another object of the present invention to provide a permanent downhole depth and orientation reference which does not prevent re-entry into the mother wellbore. These and other objects, features, and advantages of the present invention will become apparent from the drawings, the descriptions given herein, and the appended claims.

Therefore, in accordance with the present invention, a method is disclosed for providing a reference in a borehole to a selectable depth and selectable orientation, comprising one or more steps such as positioning a reference sleeve within the borehole, expanding the reference sleeve radially outwardly within the borehole at the selectable depth and with the selectable angular orientation such that the reference member fixably engages the borehole so as to be mounted in the borehole. Preferably the reference sleeve internal diameter increases as the reference sleeve expands radially outwardly so as to permit larger diameter elements to extend there through if needed.

Other steps may include providing a whipstock assembly to be removably engagable with the reference sleeve, and/or providing the whipstock assembly with mating surfaces to the reference sleeve such that when the whipstock assembly is engaged with the reference sleeve, then the whipstock assembly is positioned at the selectable depth and the selectable orientation.

In a preferred embodiment, the method may include one or more steps such as forming a new borehole section, removing the whipstock assembly, and leaving the reference sleeve within the borehole.

If it is desired to return to the original borehole, the method may include extending a pipe string past the new borehole section and through the reference sleeve. If it is then desired to return to the new borehole section, then the method may include steps such as mounting the same or equivalent whipstock assembly in the reference sleeve, and extending a pipe string into the new borehole section.

In a presently preferred embodiment the method includes the step of providing that the reference sleeve has sufficient length and hence sufficient contact area to securely affix the reference sleeve in the borehole as a result of the step of expanding.

To expand as desired, the method may provide that the reference sleeve is formed as a tubular spring. The method may then comprise compressing the reference sleeve radially inwardly in a running position, and securing the reference sleeve in the running position. At the desired borehole position, the method may further comprise releasing the reference sleeve from the running position such that the reference sleeve springs radially outwardly.

In one embodiment, the method may further comprise providing one or more reference slots in the reference sleeve for the selectable orientation, and providing one or more keys on the whipstock assembly for engaging the one or more slots for positioning the whipstock assembly at the selectable orientation. In this case, the method may also comprise guiding the one or more keys into the one or more slots with one or more guide surfaces.

Thus, an assembly is provided for selectively entering a first borehole section or a second borehole section which may comprise one or more elements such a tubular reference sleeve which is moveable between a radially closed running position and a radially open anchoring position. Preferably, the tubular reference has a smaller outer diameter in the running position so as to be movable within the first borehole. The tubular reference sleeve engages a wall of the first borehole section in the anchoring position. One or more orientation surfaces may be provided on the tubular reference sleeve such that the one or more orientation surfaces are moveable radially outwardly in the open anchoring position.

In a preferred embodiment, the tubular reference sleeve forms a spring which is expanded in the radially open position.

The assembly may further comprise a whipstock assembly having one or more mating surfaces for engaging the one or more orientation surfaces on the tubular reference sleeve.

The whipstock assembly may be removably mountable to the reference sleeve. Preferably, the reference sleeve is engagable with the borehole along a length sufficient for affixing the reference sleeve within the borehole in the anchoring position. In other words, a method may be provided for selectively entering one of a plurality of borehole sections comprising one or more steps such as radially expanding a reference sleeve to affix the reference sleeve in a first borehole section, and providing a whipstock engagable with the reference sleeve to permit entry into a second borehole section.

Additional steps may include removing the whipstock from the reference sleeve to provide for entry into the first borehole section and/or subsequently replacing the whipstock within the reference sleeve to provide for entry into the second borehole section. Other steps may preferably include providing the reference sleeve and the whipstock with mating engagement surfaces such that the whipstock is oriented when the whipstock engages the reference sleeve.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the drawing and wherein.

BRIEF DESCRIPTION OF THE PREFERRED EMBODIMENTS

Figure 1:
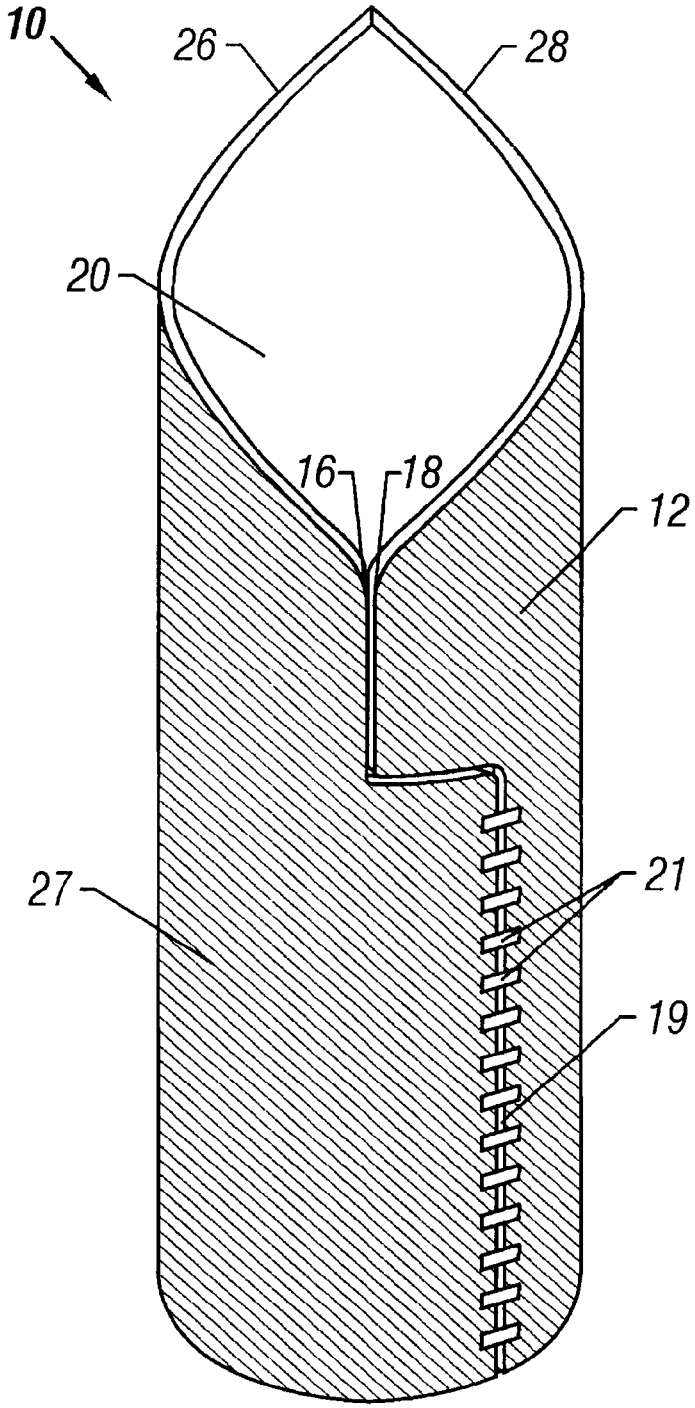
FIG. 1 is an elevational view of an embodiment of a reference sleeve in the running mode in accord with the present invention.
Figure 2:
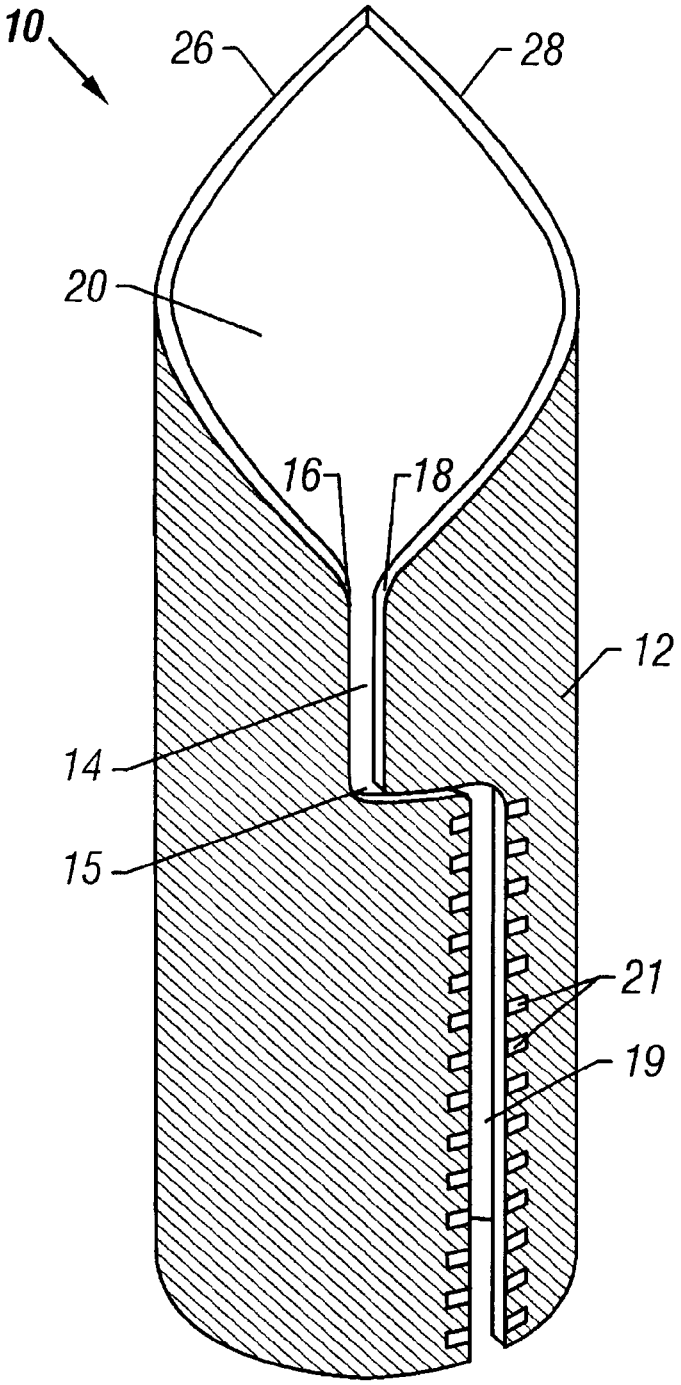
FIG. 2 is an elevational view of the embodiment of the reference sleeve from FIG. 1 in the anchoring mode in accord with the present invention.

Referring now to the drawings and, more particularly to FIG. 1 and FIG. 2, there is shown a reference sleeve 10 in accord with the locating system of the present invention. Reference sleeve 10 is preferably expandable and may preferably form a tubular spring. In the running mode, as shown in FIG. 1, reference sleeve 10 is compressed and maintained in a compressed position to thereby fit easily into the wellbore. Once reference sleeve 10 is positioned at the desired location in the borehole and oriented in a desired azimuth angle, then reference sleeve 10 is released to expand as indicated in FIG. 2. In the expanded position, outer surface 12 expands in diameter to thereby engage the wellbore. The position of slot 14 provides a permanent angular reference. The well depth position of reference sleeve 10 forms a permanent depth reference at surface 15 shown in FIG. 2 as discussed hereinafter. One or more reference sleeves 10 may be used for reliably controlling access to various borehole sections and branches from the original borehole, as discussed in more detail subsequently. The reference sleeve 10 may be used in cased hole or open hole, as desired, although in open hole it may be desirable to locate reference sleeve 10 within a consolidated formation to thereby secure reference sleeve 10 within the borehole.

Thus, the above describes the general concept of a presently preferred embodiment of the present invention that includes a reference sleeve. Various means, as desired, may be used to maintain reference sleeve 10 in the running mode and various means may be used for releasing or expanding reference sleeve 10 to engage and be anchored within the borehole. For instance, surface 16 and 18 which define slot 14 and slot 19 once reference sleeve 10 is expanded as shown in FIG. 2. Preferably in the region of slot 19, surfaces 16 and 18 may be tack welded together, bolted, pinned, disposed in a containment sleeve, or otherwise held together in the running position as shown in FIG. 1. In a presently preferred embodiment, surface 16 and 18 are tack welded in the region of slot 19 so that tack welds such as tack welds 21 do not interfere with the surface of slot 14 to permit key 30 of FIG. 3 to slide easily therein as discussed subsequently. Once at the desired position, various forces such as hydraulic force from well pumps, mechanical force from a well string, explosive force, or other means such as an inflatable packer may be used for releasing reference sleeve 10, e.g., by breaking tack welds 21. Reference sleeve 10 preferably is a tubular spring or effectively a C-spring in cross-section, and which preferably springs or moves radially outwardly to engage the borehole upon release. The elastic spring force of reference sleeve 10 then forcefully engages the borehole to grip the borehold wall. A sufficient number of closing elements, such as tack welds 21, are used to prevent the possibility of reference sleeve 10 opening prematurely so there is no risk of opening prior to the time reference sleeve is intentionally opened.

The expansion of the preferred embodiment reference sleeve 10 is a useful feature. During the expansion process, the minimum internal diameter 20 or minimum restriction through reference sleeve 10 actually increases thereby permitting larger pipe strings to pass through reference sleeve 10, if desired. Thus, reference sleeve 10, in a presently preferred embodiment, has a greater minimum internal diameter in the anchoring position than in the running position.

Outer surface 12 of reference sleeve 10, may include locking elements (not shown) such as slips, gripping elements, studs, and the like to secure reference sleeve solidly in position within the borehole. In one embodiment, spikes (not shown) may be provided within an interior of reference sleeve 10 and may be extended into an open hole formation by running a tool or drill string or whipstock anchor assembly end portion through reference sleeve 10 to thereby push the spikes into the wellbore. Gripping or locking elements may be more important in open hole rather than cased hole although they may be used for either. If desired, gripping elements may be placed mainly or exclusively lower portions of reference sleeve such as in the region of 27 but gripping elements could be positioned wherever reference sleeve 10 engages the borehole.

The length of reference sleeve 10 may be adjusted as necessary to increase the surface area that engages the wellbore to thereby increase the anchoring and gripping power of reference sleeve 10. Thus, reference sleeve 10 may be designed to have a sufficient vertical length to provide secure fastening of reference sleeve 10 within the borehole.

Reference sleeve 10 preferably includes guide surfaces such as inclined guide surfaces 26 and 28. If a downhole tool with a key such as key 30 shown on whipstock assembly 32 in FIG. 3 encounters either guide surface 26 or 28, then key 30 will be guided into slot 14 to thereby rotationally orient an azimuth of whipstock assembly 32. Key 30 then stops at surface 15 of slot 14 so that surface 15 of slot 14 forms a permanent depth reference for whipstock assembly 32. If whipstock assembly 32 is removed from the borehole, reference sleeve 10 will preferably remain anchored in position. Then later if a whipstock assembly, such as whipstock assembly 32, is once again run into the borehole then guide surfaces 26 and 28 will again guide key 30 into slot 14 so that the whipstock assembly is oriented in the same direction and at the same depth. In this manner, reference sleeve 10 facilitates entry into a new wellbore section, as discussed in more detail subsequently.

It will be understood that such terms as "up," "down," "vertical," and the like, are made with reference to the drawings and/or the earth and that the inventive devices may not be arranged in such positions at all times depending on variations in operation, transportation, and the like. It will also be understood that the drawings are intended to describe the concepts of the invention so that the presently preferred embodiments of the invention will be plainly disclosed to one of skill in the art but are not intended or required to be manufacturing level drawings or renditions of final products and therefore may include simplified conceptual views as desired for easier and quicker understanding or explanation of the invention. As well, the relative size and relative dimensions of the components may be greatly different from that shown. Moreover, while an angled borehole 22, with respect to the vertical, is shown in FIG. 4 and FIG. 5 for purposes of explanation, it will be understood that borehole 22 may or may not involve angled boreholes, i.e., deviated boreholes.

Figure 3:
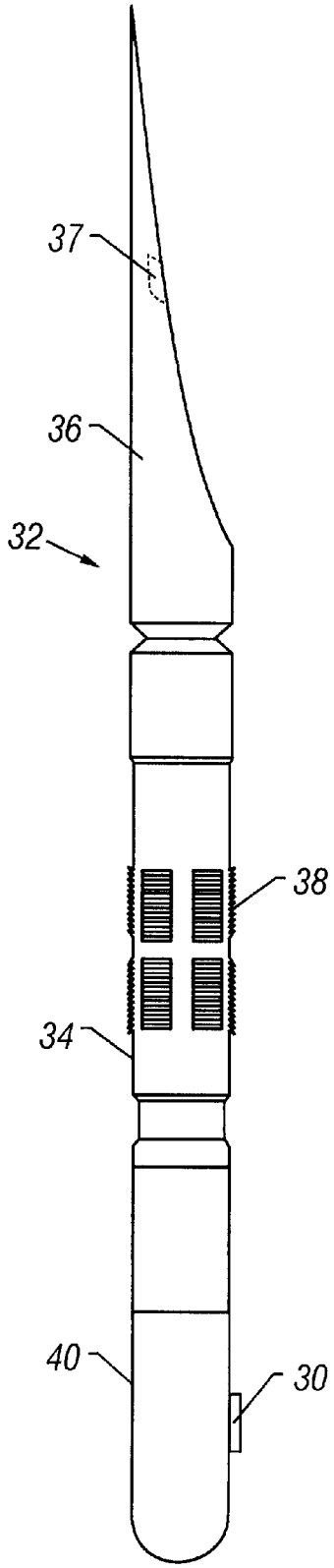
FIG. 3 is an elevational view, of a whipstock assembly with a key for mating to the reference sleeve of FIG. 2.

FIG. 3 discloses an example of a whipstock assembly, such as whipstock assembly 32, that may be used in combination with reference sleeve 10. Whipstock assembly 32 may preferably include an anchor section 34 and a whipstock 36. Whipstock anchor section 34 may include slips 38 or other means such as gripping elements, expandable elements, packers, and the like, to secure whipstock 36 in position within the borehole. Whipstock 36 may include slot 37 or other means for latching onto whipstock 36 for removal purposes, if desired.

A preferred embodiment of the present invention includes mating end or bull nose 40 which is sized to mate with interior 20 of reference sleeve 10. End 40 may be made as an integral part of whipstock assembly 32 or may be attached thereto with pins, threads, bolts, or the like. Key 30 is guided by guide surfaces 26 and 28 of reference sleeve 10 into slot 14 as discussed above. Whipstock assembly 32 and reference sleeve 10 may be initially run together or not depending on the design but are preferably separable such that whipstock assembly 32 may be retrieved from the wellbore, if desired, leaving reference sleeve 10 anchored in the borehole to provide a future depth and orientation reference when needed. In a presently preferred embodiment, reference sleeve 10 is set in the wellbore prior to running whipstock assembly 32 such as by inflating a packer. The packer is then deflated and removed. Then whipstock assembly 32 is inserted into reference sleeve 10 such that key 30 is guided into slot 14 and stops on slot bottom surface 15.

Figure 4:
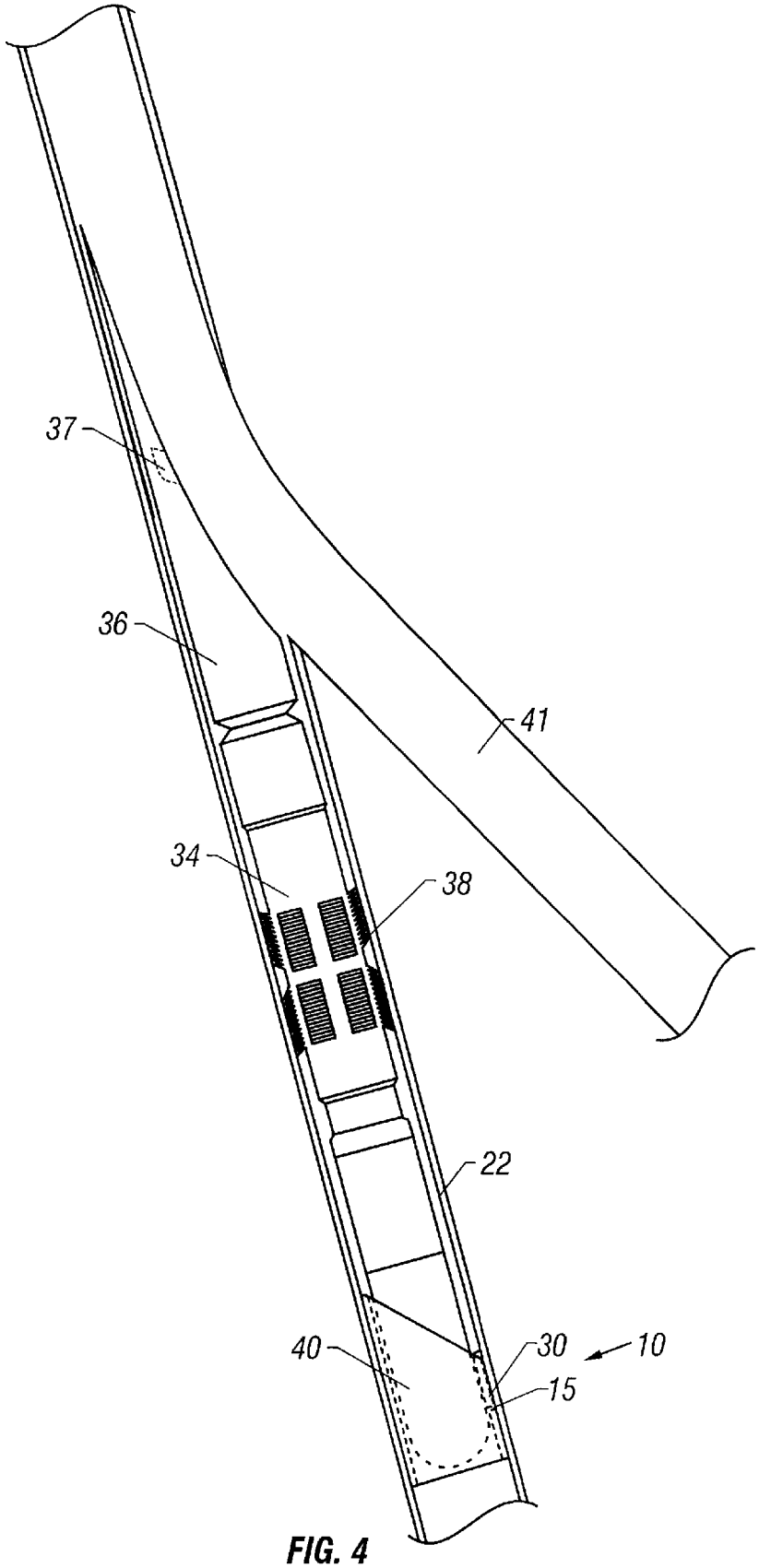
FIG. 4 is an elevational view of an original borehole and a new borehole section branching from the original borehole with a whipstock assembly and locating sleeve for directing pipe strings into the new borehole section.
Figure 5:
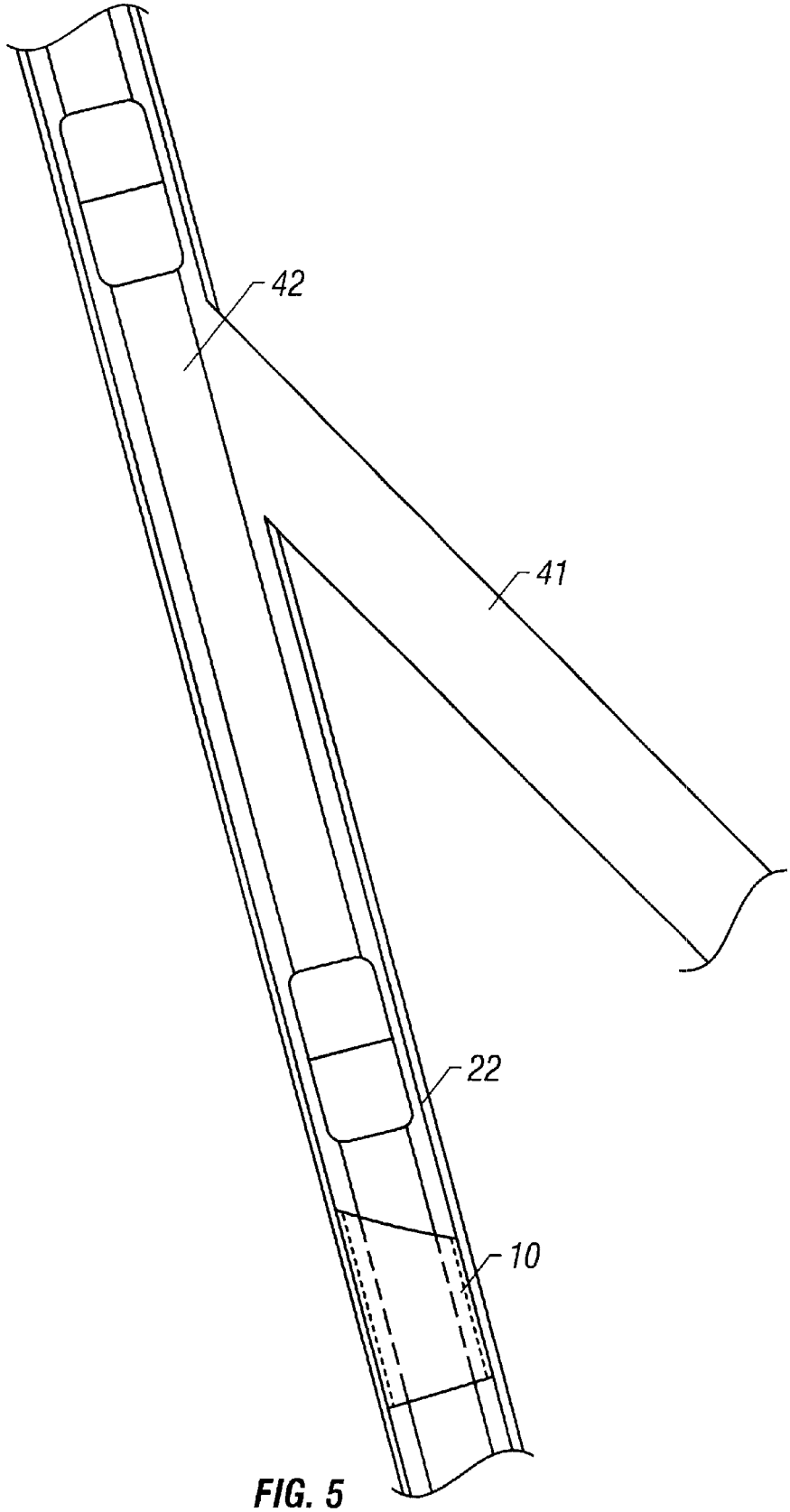
FIG. 5 is an elevational view showing the whipstock assembly removed to permit entry of a pipe string into the original borehole.

FIG. 4 shows locating sleeve 10 in position with anchor section 34 positioned therein and whipstock 36 oriented by means of key 30 such that whipstock face (unnumbered) may be used to guide a drill string, production string, milling string, or the like, for forming and entering new borehole section 41 which extends from original borehole section 22. In FIG. 4, whipstock assembly 32 is preferably anchored by expanding means such as slips 38. It is well known that with whipstock 36 positioned correctly that it is possible to reliably enter into new borehole section 41. However, in some cases, it may be desirable to go back into the original wellbore 22. In accord with the present invention, whipstock assembly 32 including anchor section 34 and whipstock 36 may be removed as indicated in FIG. 5. The large internal diameter of reference sleeve 10 permits pipe string 42, which may be a production string, drill string, or the like, to pass through reference sleeve 10 into original borehole 22.

However, at some later time, perhaps years later, it may be desirable to reenter new borehole section 41. In that case, whipstock assembly 32 or an equivalent may be run back into the wellbore and will be guided into the same exact position as suggested by FIG. 4. Thus, FIG. 4 may represent both an initial and/or a later positioning of whipstock assembly 32 within reference sleeve 10. In the past, to reposition a whipstock assembly into a previous position has been difficult, inaccurate, and time consuming.

In a preferred embodiment, the inner diameter of reference sleeve 10 after expansion may in many cases be in the range of only ten to twenty percent less than the original inner diameter of the borehole. However, depending on hole conditions, types of casing, and the like this range may vary widely in particular cases. As one typical example, the casing may be 9⅝ inches outer diameter, and approximately 8½ inches inner diameter depending on the casing weight. In such as case, the inner diameter of reference sleeve 10 may be approximately 7¾ inches. Since the restriction created by reference sleeve 10 is typically only slightly smaller than the casing in which reference sleeve 10 may be positioned, no obstruction and/or re-entry problems are created. For instance, if desired to drill further in the mother borehole section, a bicentered or offset bit may be used to thereby drill a hole that is the same size or perhaps larger than the inner diameter of the casing.

The present invention may provide for multiple reference sleeves 10 within the borehole. If desired, key 30 may be run in a retracted position so as to permit whipstock assembly 32 to pass through a plurality of reference sleeves 10 and then be extended to engage a particular desired reference sleeve 10 in the manner discussed above. For instance, key 30 may be biased inwardly during running and then hydraulic pressure or other powering means may be used to extend and lock key 30 into position. Breakable pins and/or other means could be used to retrack key 30 again when it is desired to retrieve whipstock assembly 32 through multiple reference sleeves 10. Thus, the present invention may be used in wells with multiple branches and multiple reference sleeves 10.

While one preferred embodiment of the present invention utilizes a whipstock assembly, the present invention provides other important and highly useful reference functions. As one example, when perforating deep wells especially when casing collars are at closely equal lengths, wireline stretch can make determination of the position of the perforating gun difficult. Typically, a correlation log, such as a gamma ray and/or neutron log is run prior to perforating with a collar locator to indicate collar positions relative to the formation zone to be perforated. The reference sleeve of the present invention will provide a very convenient and clear marking in even deep boreholes that adds great confidence that the perforating gun is positioned correctly while significantly reducing collar correlation time. It is well known that perforating out of zone requires extensive rig time to repair. The use of the present invention, effectively obviates the likelihood that a well will be perforated out of zone with the resulting damages and costs involved.

In summary, reference sleeve 10 may be run separately or in conjunction with whipstock assembly 32. In one embodiment, reference sleeve 10 might be run with an expandable packer. The combination may be oriented by means known in the prior art. Once oriented, reference sleeve 10 is expanded such as by breaking the tack welds that hold reference sleeve 10 in the running position such that outer walls 12 engage the borehole such as original borehole 22. Whipstock assembly 32 is then run into the hole, inserted into reference sleeve 10, and whipstock 36 is oriented by key 30 going into slot 14. Slips 38 on whipstock assembly 32 may then be set to anchor the whipstock assembly in position. The new borehole section 41 may be milled, drilled, and used as desired. If re-entry into original borehole section 22 is desired, then whipstock assembly 32 may be removed, which may involve shearing pins to release the slips. With whipstock assembly 32 removed, a pipe string may be run through the large inner diameter of expanded reference sleeve 10. Subsequently, if desired to go back into new borehole section 41, even years later, then whipstock assembly 32 can be run back into the hole, engage reference sleeve 30, whereby key 30 orients whipstock 36 directly and reliably towards new borehole section 41. Thus, the present invention may be used at multiple positions within the wellbore, if desired. Any branch or section of the wellbore can be reliably reentered as desired.

While the discussion above relates to using an expandable reference sleeve 10 such as tubular spring or a C-spring when viewed in cross-section, other means may be used to expand reference sleeve 10 such as hydraulics, multiple hinged sections through which a sleeve is used to compress the sections outwardly, or other means to expand reference sleeve 10 as desired.

Thus, numerous variations of the above system and method are possible, some of which have already been described. Therefore, it will be understood that many additional changes in the details, materials, steps and arrangement of parts, may be made by those skilled in the art within the principle and scope of the invention as expressed in the appended claims.

What is claimed is:

1. A method for providing one or more references in a borehole for a selectable depth and selectable orientation, said method comprising:

positioning a reference sleeve within said borehole; and expanding said reference sleeve radially outwardly within said borehole at said selectable depth and with said selectable orientation such that said reference member fixably engages said borehole so as to be mounted in said borehole, said reference sleeve internal diameter increasing as said reference sleeve expands radially outwardly.

2. The method of claim 1, further comprising:

providing a whipstock assembly to be removably engagable with said sleeve;

providing said whipstock assembly with mating surfaces to said reference sleeve such that when said whipstock assembly is engaged with said reference sleeve then said whipstock assembly is positioned at said selectable depth and said selectable orientation.

3. The method of claim 2, further comprising:

forming a new borehole section, removing said whipstock assembly, and leaving said reference sleeve within said borehole.

4. The method of claim 3, further comprising:

extending a pipe string past said new borehole section and through said reference sleeve.

5. The method of claim 4, further comprising:

mounting said whipstock assembly in said reference sleeve, and extending a pipe string into said new borehole section.

6. The method of claim 2, further comprising:

providing one or more reference slots in said reference sleeve for said selectable orientation, and providing one or more keys on said whipstock assembly for engaging said one or more slots for positioning said whipstock assembly at said selectable orientation.

7. The method of claim 6, further comprising:

guiding said one or more keys into said one or more slots with one or more guide surfaces.

8. The method of claim 6, further comprising:

radially extending said one or more keys.

9. The method of claim 1, further comprising:

providing that said reference sleeve has sufficient length to securely affix said reference sleeve in said borehole during said step of expanding.

10. The method of claim 1, further comprising:

providing that said reference sleeve is formed as a tubular spring.

11. The method of claim 10, further comprising:

compressing said reference sleeve radially inwardly in a running position, and securing said reference sleeve in said running position.

12. The method of claim 11, wherein said step of expanding further comprises:

releasing said reference sleeve from said running position such that said reference sleeve springs radially outwardly.

13. The method of claim 1, further comprising:

utilizing said reference sleeve as a wireline logging reference.

14. An assembly for selectively entering a first borehole section or a second borehole section, comprising:

a tubular reference sleeve, said tubular reference sleeve being moveable between a radially closed running position and a radially open anchoring position, said tubular reference sleeve defining a minimum internal diameter which is greater in said anchoring position than in said running position, said tubular reference sleeve being movable within said first borehole section in said running position, said tubular reference sleeve engaging a wall of said first borehole section in said anchoring position, and one or more orientation surfaces on said tubular reference sleeve.

15. The assembly of claim 14, further comprising:

said tubular reference sleeve forming a tubular spring which is expanded in said radially open position.

16. The assembly of claim 14, further comprising:

a whipstock assembly, said whipstock assembly having one or mating surfaces for engaging said one or more orientation surfaces on said tubular reference sleeve.

17. The assembly of claim 16, further comprising:

said whipstock assembly being removably mountable with respect to said reference sleeve.

18. The assembly of claim 14, wherein:

said reference sleeve is engagable along a length sufficient for affixing said reference sleeve within said borehole in said anchoring position.

19. A method for selectively entering one of a plurality of borehole sections, said method comprising:

radially expanding a reference sleeve to affix said reference sleeve in a first borehole section; and providing a whipstock engageable with said reference sleeve to permit entry into a second borehole section.

20. The method of claim 19, further comprising:

removing said whipstock from said reference sleeve to provide for entry into said first borehole section.

21. The method of claim 20, further comprising:

replacing said whipstock into said reference sleeve to provide for entry into said second borehole section.

22. The method of claim 21, further comprising:

providing that said reference sleeve has a sufficient length along which said first borehole is engaged to thereby affix said reference sleeve within said first borehole.

23. The method of claim 19, further comprising:

providing said reference sleeve and said whipstock with mating engagement surfaces such that said whipstock is oriented when said whipstock engages said reference sleeve.

24. The method of claim 19, further comprising:

providing a key for orienting said whipstock with respect to said reference sleeve.

25. The method of claim 19, further comprising:

extending said key radially outwardly.

* * * * *